US005493881A

United States Patent [19]

Harvey

[11] Patent Number: 5,493,881

[45] Date of Patent: Feb. 27, 1996

[54] ELECTRIC DOOR LOCK FOR VEHICLE STORAGE COMPARTMENTS

[76] Inventor: Steven M. Harvey, 101-B W. McKnight Way, Grass Valley, Calif. 95949

[21] Appl. No.: 122,096

[22] Filed: Sep. 17, 1993

[51] Int. Cl.[6] ..... E05B 47/00

[52] U.S. Cl. ..... 70/277; 70/279; 70/283; 70/DIG. 52; 74/89.17; 74/100.1; 292/144; 292/153; 292/335; 292/DIG. 61

[58] Field of Search ..... 70/208, 279, 283, 70/DIG. 52, 277, 280, 281, 282, DIG. 42, DIG. 54; 292/DIG. 61, DIG. 62, 144, DIG. 31, 172, 153, 335; 74/100.1, 89.17

[56] References Cited

U.S. PATENT DOCUMENTS

| | | | |
|---|---|---|---|
| 1,417,963 | 5/1922 | Zawistowski | 70/DIG. 42 X |
| 1,495,820 | 5/1924 | Tierney | 292/DIG. 62 X |
| 1,989,801 | 2/1935 | Halinka | 70/208 |
| 2,297,381 | 9/1942 | Wylie | 74/100.1 X |
| 2,299,646 | 10/1942 | Muller | 70/283 |
| 3,782,140 | 1/1974 | Price | 292/DIG. 23 X |
| 4,458,930 | 7/1984 | Goike et al. | 292/201 |
| 4,519,227 | 5/1985 | Dumbser et al. | 70/280 X |
| 4,573,333 | 3/1986 | Choi | 70/279 |
| 4,659,121 | 4/1987 | McGee | 292/DIG. 53 X |
| 4,714,030 | 12/1987 | Cole | 70/283 X |
| 4,951,486 | 8/1990 | Braun et al. | 70/208 |
| 5,077,991 | 1/1992 | Stickel et al. | 70/DIG. 52 X |

*Primary Examiner*—Lloyd A. Gall
*Attorney, Agent, or Firm*—Timothy T. Tyson; Joseph Compton; Freilich, Hornbaker & Rosen

[57] ABSTRACT

A locking system (20) allows a plurality of vehicle service doors (22) to be locked and unlocked by operating a single electrical switch in a suitable location such as the vehicle cab. The locking system (20) includes a lock (24) having a bolt (26) and a blocking cam (40). An actuator (144) moves the acm (40) between locked and unlocked positions via an extension member (46). The actuator (144) includes an actuating member in the form of a combined piston (148) and rack (150). A spring (170) urges rack (150) to remain in either of two selected positions.

8 Claims, 4 Drawing Sheets

ELECTRIC DOOR LOCK FOR VEHICLE STORAGE COMPARTMENTS

TECHNICAL FIELD

The present invention relates generally to door locks and more particularly to electrical locks for vehicle storage compartments.

BACKGROUND OF THE INVENTION

Storage compartments are built into a variety of vehicles such as rescue emergency units, ambulances, service trucks and delivery vans. Locks designed for the doors of these compartments typically are key operated. It is time consuming, especially when a vehicle has a plurality of compartments, to move to each door and lock or unlock it. This arrangement, therefore, reduces vehicle user productivity. Additionally, it can also compromise security because the user may choose to avoid a tiresome, repetitious task. A locking system operable by a single electrical switch offers improved productivity and security.

SUMMARY OF THE INVENTION

The present invention is directed to locking systems for vehicle storage compartments.

Systems in accordance with the invention are characterized by an electrically operated actuator having an actuating member movable between first and second positions which move a cam between an unlocked position spaced from a lock bolt to a locked position blocking movement of the lock bolt. The actuator includes a spring arranged between the actuating member and the actuator housing to resist movement of the actuating member from its first and second positions which might be caused by vehicle motion. The spring is arranged to have its first and second ends closer together in a third actuating member position than in the first and second positions wherein the third position is between the first and second positions.

In a preferred embodiment, the cam defines an aperture to receive the lock cylinder associated with the lock bolt. The cam also defines a lobe extending from the aperture to receive a radially extending ear of the lock cylinder over substantially 90 degrees of cylinder travel. Thus key and electrical operation of the lock are accommodated.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
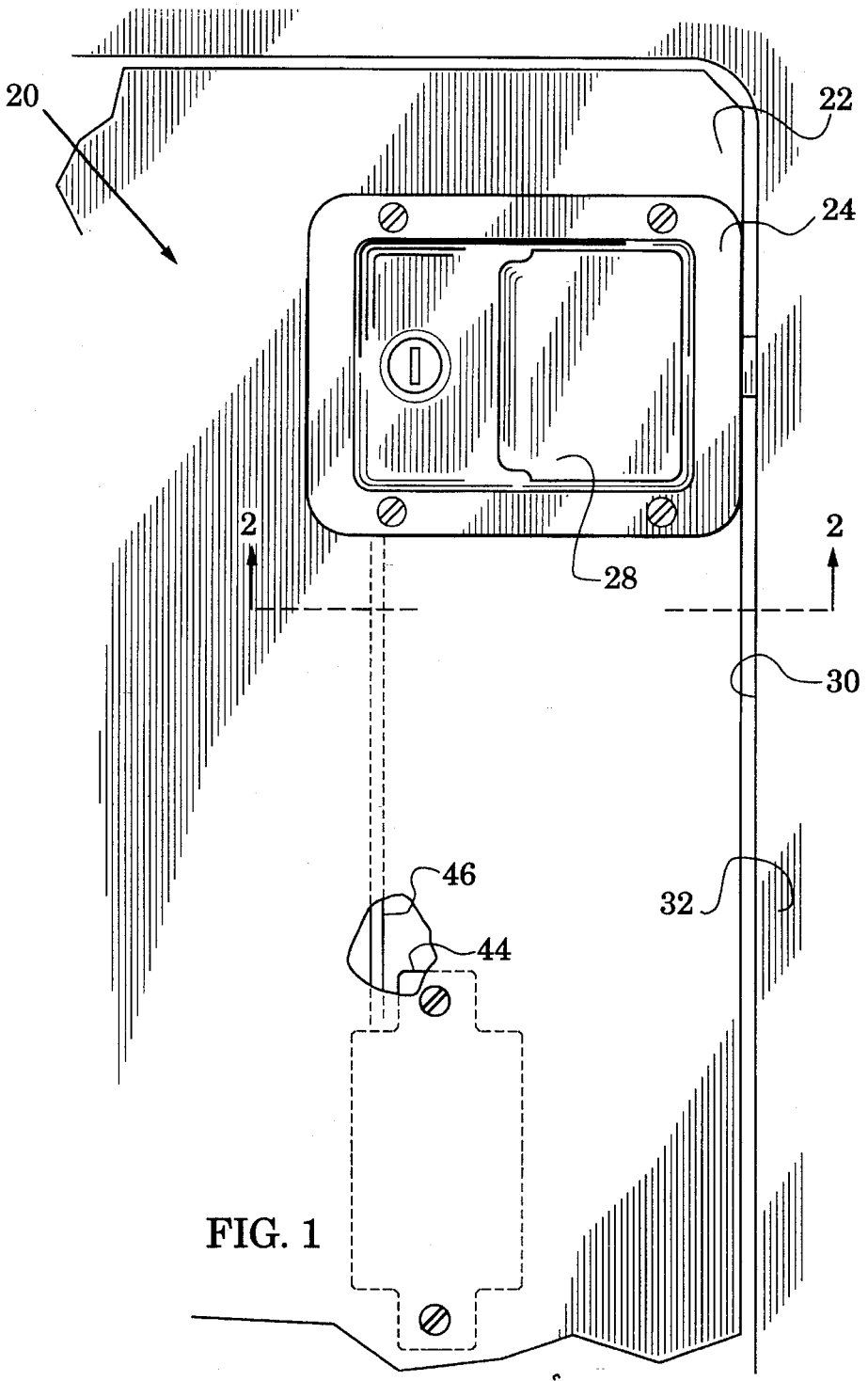
FIG. 1 is a front elevation view of a preferred locking system embodiment, in accordance with the present invention, installed on a vehicle storage compartment door.
Figure 2:
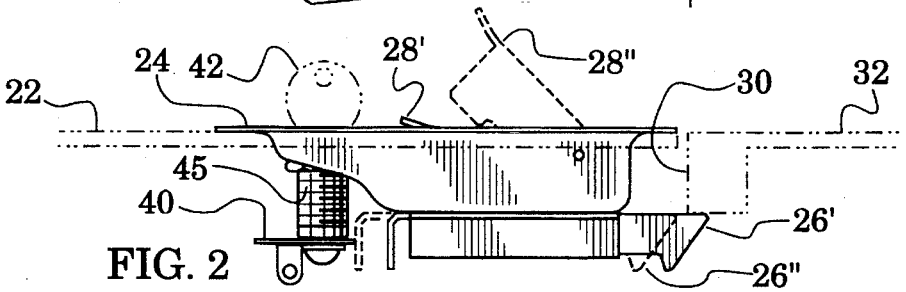
FIG. 2 is a view along the plane 2—2 of FIG. 1.

FIG. 1 is a front elevation view of a preferred locking system embodiment 20 installed on a vehicle storage compartment door 22 while FIG. 2 is a view along the plane 2—2 of FIG. 1. These views illustrate a door lock 24 having a bolt 26 that can be moved between a closed position 26' and an open position 26" by swinging a handle 28 from a rest position 28' to a release position 28". When the bolt 26 is in the closed position 26' it can engage a jamb 30 of the vehicle storage compartment wall 32 to keep the door 22 shut, thus securing the contents of the storage compartment.

A rotatable cam 40 is shown in its unlocked position in FIG. 2 but when rotated to a locked position, the cam 40 blocks the bolt 26 from moving to its open position 26". In the system 20, rotation of the cam 40 into the lock position may be accomplished manually with a key 42 or electrically with an electrical actuator 44 that is connected to a switch in a suitable location such as the vehicle cab. The actuator 44 moves the cam 40 via an extension member 46.

As mentioned in the background section, many vehicles, e.g., rescue emergency units, ambulances and service trucks, carry numerous storage compartment doors. They are often equipped with a lock of the type represented by the lock 24 (commonly referred to as "paddle handle" locks). Typically, each of these locks must be locked one at a time by operating the key cylinder (inside the key body 45) with the key 42. The time required for this results in decreased productivity. In addition, because the task is time consuming and tedious, vehicle operators tend to leave doors unlocked which results in decreased security.

Installation of the system 20 permits all doors to be locked and unlocked simultaneously by operation of the cab switch. The ease of this operation enhances the security of the vehicle and the productivity of its operators. The system can incorporate both manual and electrical operation or, alternatively, electrical operation only.

Figure 3A:
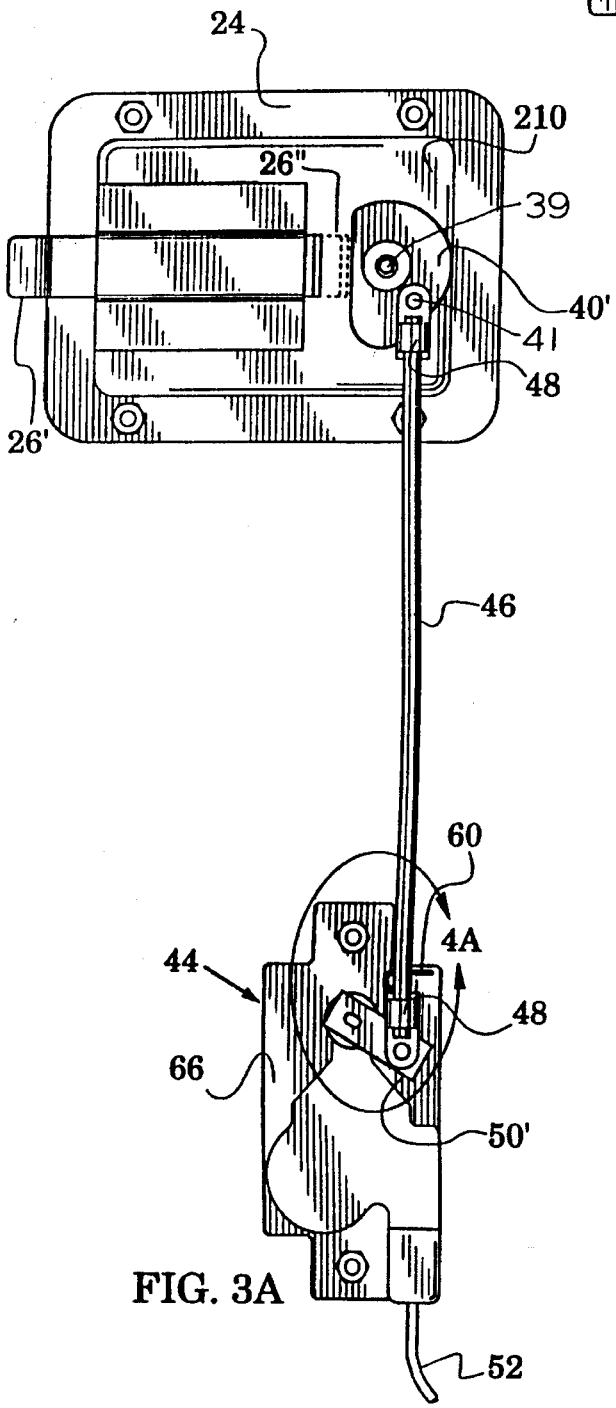
FIG. 3A is a rear elevation view of the system of FIG. 1 illustrating a first actuating member position.
Figure 3B:
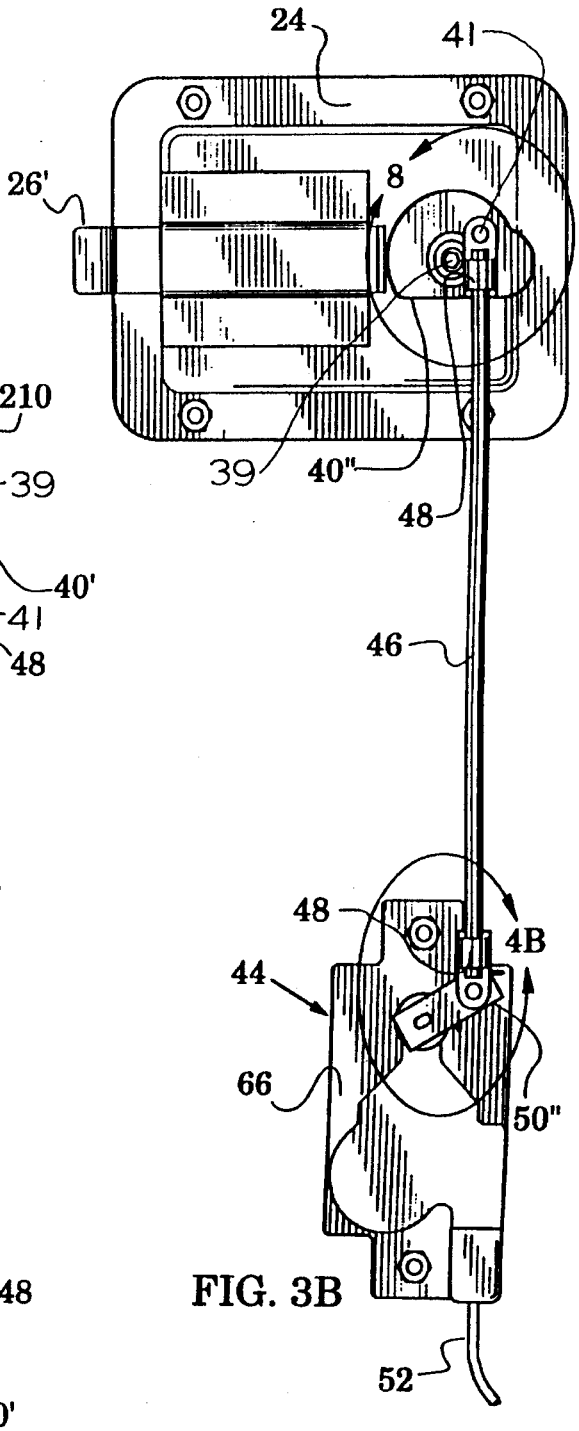
FIG. 3B is a view similar to FIG. 3A illustrating a second actuating member position.

Attention in now directed to details of the system embodiment 20. In addition to FIGS. 1, 2, the system is illustrated in the rear elevation views of FIGS. 3A and 3B. FIGS. 3A and 3B respectively show first and second positions of the extension member 46. The extension member 46 has, at each end, rotatable fittings 48 which connect to the cam 40 and to a movable actuating member in the form of a rotatable arm 50. Cam 40 rotates about first pivot point 39. Extension member 46 is connected to cam 40 through rotatable fitting 48 at second pivot point 41 which is offset from first pivot point 39. The actuator 44 is responsive to an electrical command via its connecting cord 52 for moving the arm 50 between an unlocked radial position 50' in FIG. 3A and a locked radial positions 50" in FIG. 3B. Movement of the arm 50 between these radial positions rotates, via the extension member 46, the cam 40 between its unlocked and locked positions 40' and 40".

Thus, when the arm is in radial position 50', the bolt 26 is free to move, in response to the handle 28 of FIGS. 1 and 2, between its open and closed positions 26', 26" as shown in FIG. 3A. When the arm 50 is in radial position 50", the bolt 26 is blocked from moving to its open position as shown in FIG. 3B.

Figure 4A:
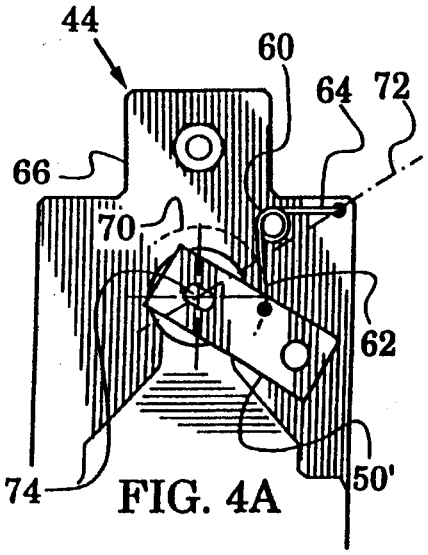
FIG. 4A is an enlarged view of the area 4A of FIG. 3A.
Figure 4B:
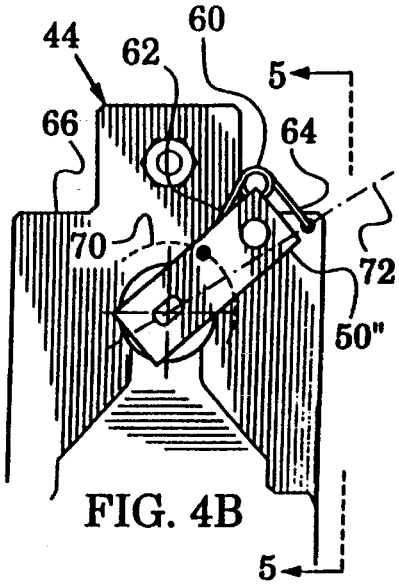
FIG. 4B is view similar to FIG. 4A.
Figure 5:
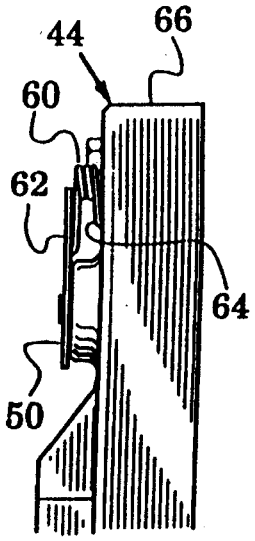
FIG. 5 is a view along the plane 5—5 of FIG. 4B.

FIGS. 4A, 4B are enlarged views respectively of the areas 4A, 4B of FIGS. 3A, 3B with the extension member 46 and fitting 48 removed for clarity of illustration. FIG. 5 is a view along the plane 5—5 of FIG. 4B. These views illustrate a coil spring 60 having first and second ends 62, 64 received respectively in holes in the arm 50 and the actuator housing 66. In FIGS. 4A, 4B the arm 50 is respectively in first and second radial positions 50', 50". It is apparent that between these positions, the termination of the spring 62 first end moves along an arc 70. Therefore, it is also apparent that when the arm 50 occupies a third radial position indicated by the broken line 72 connecting the arm pivot axis 74 and the hole receiving the spring second end 64, the first and second spring ends 62, 64 are closer together than when the arm 50 is in its first and second positions 50', 50". Since the spring 60 resists having its ends moved together, it urges the arm 50 to remain in either position 50' or 50". The spring restoring force is selected to be overcome by the actuator 44 but sufficient to keep the arm 50 in its last commanded position during vibrations and accelerations of the vehicle during its operation over roads and streets.

Figure 6:
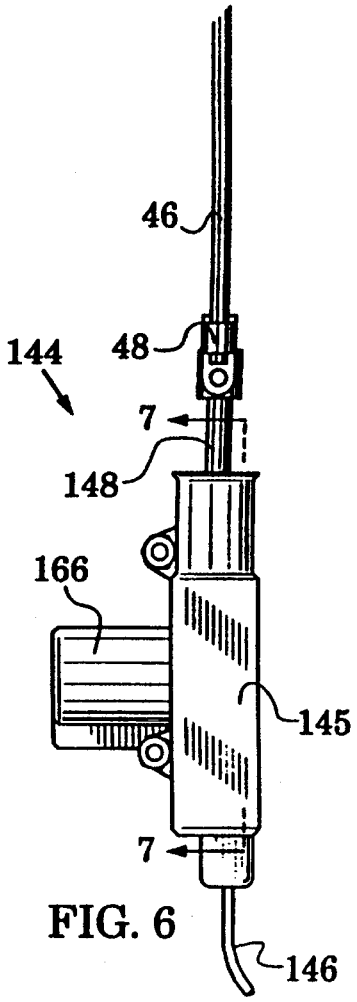
FIG. 6 is a view similar to a portion of FIG. 3A illustrating another preferred actuator.
Figure 7:
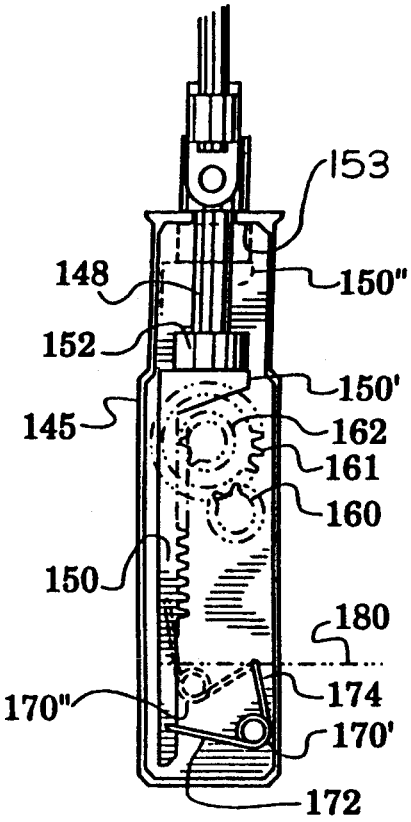
FIG. 7 is a view along the plane 7—7 of FIG. 6.

FIG. 6 is a view similar to a portion of FIG. 3A showing another actuator embodiment 144 having a housing 145 and slidable piston 148. A fitting 48 is rotatably carried at the end of the piston 148 to receive the end of the extension member 46. FIG. 7 is a sectional view along the plane 7—7 of FIG. 6 which illustrates that the piston 148 is carried by a rack 150 and has a resilient washer 152 at the intersection of the rack 150 and the piston 148.

The piston slides between first and second positions indicated respectively by positions 150', 150" of the connecting rack. The resilient washer 152 abuts the end 153 of the housing 145 when the rack is in position 150" (for clarity of illustration only the end of the rack is shown in broken lines in position 150"). Thus, the actuator 144, in response to electrical commands received over a connecting cord 146, moves an actuating member in the form of the combined piston 148 and rack 150.

A series of gears 160, 161 and 162 converts rotary motion from an electrical motor housed in an extension 166 of the housing 145 to linear motion of the rack 150. In a manner similar to the actuator 44 of FIGS. 4A, 4B, a coil spring 170 has its first and second ends 172, 174 received respectively in holes in the rack 150 and the actuator housing 145. As the rack 150 moves between positions 150', 150", the spring 170 moves between respective positions 170', 170". It is apparent that between these positions, the termination of the spring first end 172 moves linearly. Therefore, it is also apparent that when the rack 150 occupies a third linear position where the hole receiving the spring first end 172 intersects a broken line 180 which passes through the hole receiving the spring second end 174 and is normal to the rack 150, the first and second spring ends 172, 174 are closer together than when the rack is in its first and second positions 150', 150". Thus the restoring force of the spring 170 urges the rack to remain in either of the selected positions 150', 150".

Figure 8A:
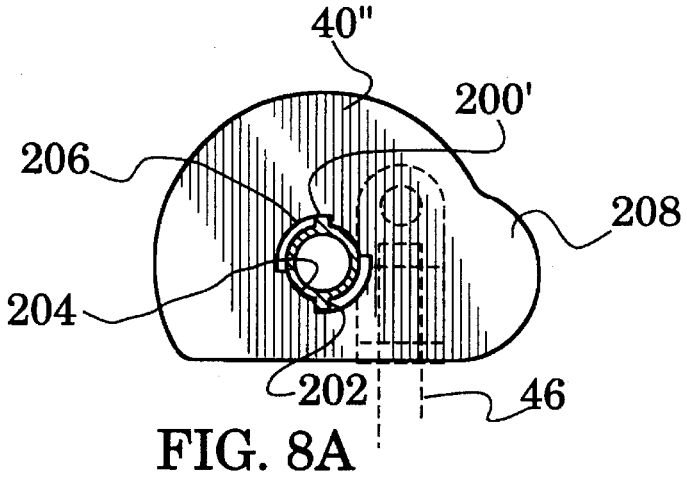
FIG. 8A is an enlarged view of the area 8 of FIG. 3B showing a cam and key cylinder position.
Figure 8B:
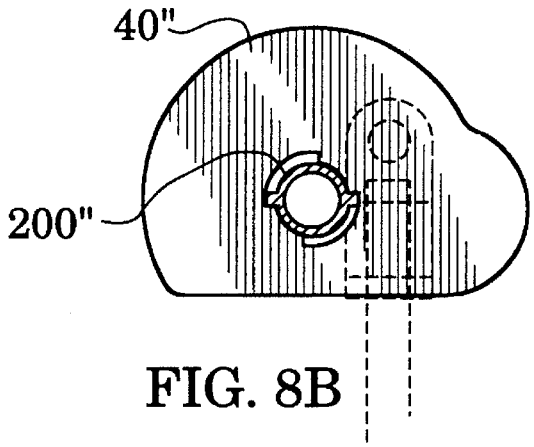
FIG. 8B is a view similar to FIG. 8A showing another cam and key cylinder position.

FIGS. 8A, 8B are enlarged views of the area 8 of FIG. 3B illustrating respectively the locked and unlocked positions of the key cylinder 200 where the hardware to lock the cam 40 to the key cylinder has been eliminated for clarity of illustration. The key cylinder 200 defines or includes radially projecting ears 202 circumferentially spaced 180 degrees apart. The cam 40 defines an aperture 204 which receives the key cylinder 200 and, as part of this aperture, defines two outward radially extending lobes 206 which each extend circumferentially sufficiently far to allow the ears 202 to clear the cam 40 as the key cylinder 200 is rotated 90 degrees. Further rotation causes the ears 202 to abut the cam 40.

The key cylinder 200 is shown in an unlocked position 200' in FIG. 8A and a locked position 200" in FIG. 8B. These two positions are 90 degrees apart. It is apparent, with reference to FIGS. 3A, 3B, that the actuator 44 can rotate the cam 40 to either of positions 40', 40" when the key cylinder 200 is in its unlocked position 200' of FIG. 8A. It is also, apparent that when the key cylinder is in its locked position 200" of FIG. 8B, the actuator is blocked from rotating the cam 40.

Figure 8C:
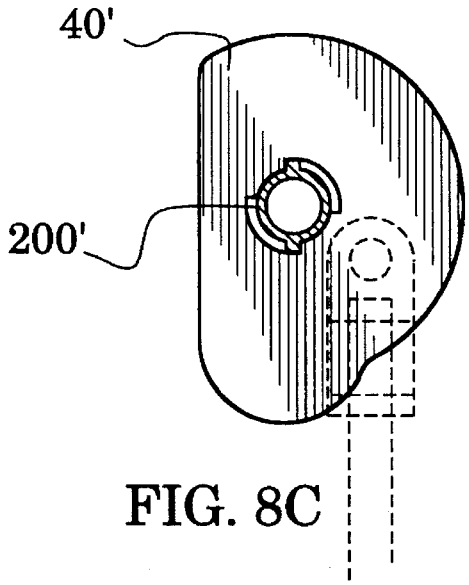
FIG. 8C is a view similar to FIG. 8A showing another cam and key cylinder position.

In FIG. 8C the key cylinder is in the unlocked position 200' and the cam in the unlocked position 40'. It is apparent that the key cylinder can now be rotated with the key 42 (shown in FIG. 2) to the locked position 200" of FIG. 8B, pulling the extension member 46 along in the process, i.e., rotation of the key cylinder overcomes the spring loaded actuator at the end of the extension member and moves it between its two positions.

From the foregoing, it should now be recognized that locking system embodiments have been disclosed herein especially suited for vehicle storage compartments. Although the systems have been shown incorporating a paddle handle lock, the teachings of the invention may be extended to other service vehicle locks generally used for storage compartments, e.g., T handle and D handle locks.

The spring loaded electrical actuator (44 of FIG. 3A, 144 of FIG. 6) is arranged with its extension member 46 defining a 90 degree angle with the bolt 26 slide direction in FIGS. 1, 3A and 3B. However, in other embodiments, the spring loaded actuator can be arranged at any angle suitable for connection with the cam 40. The cam can be suitably dimensioned for these installations, e.g., with a cam extension 208 shown in FIG. 8A. Additionally, other embodiments of the invention may use different extension member configurations, e.g., an extension similar to a speedometer cable may be suitable for installations where intervening structure must be accommodated. Other embodiments of the invention may also utilize an equivalent location of the springs 60 and 170 (FIGS. 4A, 7). For example, in FIG. 3A, the spring 60 could perform an equivalent function when located between the cam 40 and the shell 210 of the lock 24. Locking systems in accordance with the invention have been illustrated installed on a storage compartment door to engage an adjacent jamb. They can, of course, also be installed, where appropriate, on a storage wall to engage a storage door.

Apparatus in accordance with the present invention provide means for electrically locking a plurality of vehicle storage compartment locks. The ease of use of these systems offers increased vehicle security and user productivity.

The preferred embodiments of the invention described herein are exemplary and numerous modifications, dimensional variations and rearrangements can be readily envisioned to achieve an equivalent result, all of which are intended to be embraced within the scope of the appended claims.

What is claimed is:

1. A method of selectively locking or unlocking a vehicle storage compartment in response to electrical signals, comprising the steps of:

providing a lock including a handle, a bolt slidable from a closed position to an open position in response to said handle and a cam mounted to rotate about a first pivot point from an unlocked position spaced from said bolt to a locked position blocking said bolt from sliding to said open position;

providing an electrically operated actuator including a base and an actuating member movably carried by said base, said actuating member movable between first and second positions in response to said electrical signals received by said actuator;

mounting a spring to have its first and second ends respectively connected to said base and said actuating member so that said actuating member has a third position between said first and second positions wherein said spring first and second ends are spaced closer together than in said first and second positions;

connecting said cam and said actuating member with an extension member, said extension member connected to said cam at a second pivot point offset from said first pivot point; and, applying said electrical signals to said actuator so that said actuator selectively moves said cam, via said extension member, to either said locked position or said unlocked position.

2. A vehicle storage compartment locking system responsive to electrical signals, comprising:

a lock having a handle, a bolt slidable from a closed position to an open position in response to said handle and a cam mounted to rotate about a first pivot point from an unlocked position spaced from said bolt to a locked position blocking said bolt from sliding to said open position;

an electrically operated actuator including a base and an actuating member movably carried by said base, said actuating member movable between first and second positions in response to said electrical signals received by said actuator, said actuator also including a spring having first and second ends respectively connected to said base and said actuating member, said actuating member having a third position between said first and second positions wherein said spring first and second ends are spaced closer together than in said first and second positions;

an extension member connecting said cam and said actuating member so that said actuating member forces said cam between said unlocked and locked positions when said actuating member moves between said first and second positions, said extension member connected to said cam at a second pivot point offset from said first pivot point; and, said vehicle storage compartment locking system adapted to selectively lock or unlock a plurality of vehicle storage compartments.

3. The locking system of claim 2 wherein said actuating member comprises a slidable piston and said first, second and third positions thereof comprise linear positions.

4. The locking system of claim 2 wherein said spring comprises a coil spring.

5. The locking system of claim 2 wherein said lock further comprises a key operated lock cylinder having at least one radially extending ear and said cam defines an aperture to receive said cylinder and a lobe extension of said aperture to receive said ear over substantially 90 degrees of rotation of said cylinder, said lock cylinder having an unlocked cylinder position wherein said actuator can rotate said cam to either said locked position or to said unlocked position.

6. A spring loaded actuator responsive to electrical signals and directed to use in vehicle storage compartment locking systems, comprising:

an electrically operated actuator including a base and an actuating member movably carried by said base, said actuating member comprising a piston carried by a linearly moving rack, said actuating member movable between first and second positions in response to said electrical signals received by said actuator; and, a spring having first and second ends respectively connected to said base and said actuating member, said actuating member having a third position between said first and second positions wherein said spring first and second ends are spaced closer together than in said first and second positions.

7. The actuator of claim 6 wherein said first, second and third positions comprise linear positions.

8. The actuator of claim 6 wherein said spring comprises a coil spring.

* * * * *